US009506212B2

(12) United States Patent
Wendt

(10) Patent No.: US 9,506,212 B2
(45) Date of Patent: Nov. 29, 2016

(54) UNIVERSAL CONNECTING ELEMENT FOR SHEET PILE WALL COMPONENTS

(75) Inventor: Roberto Redondo Wendt, Austin, TX (US)

(73) Assignee: PilePro LLC, Austin, TX (US)

( * ) Notice: Subject to any disclaimer, the term of this patent is extended or adjusted under 35 U.S.C. 154(b) by 0 days.

(21) Appl. No.: 14/113,106

(22) PCT Filed: Apr. 20, 2012

(86) PCT No.: PCT/IB2012/000786

§ 371 (c)(1),
(2), (4) Date: Dec. 27, 2013

(87) PCT Pub. No.: WO2012/143791

PCT Pub. Date: Oct. 26, 2012

(65) Prior Publication Data

US 2014/0112725 A1 Apr. 24, 2014

Related U.S. Application Data

(60) Provisional application No. 61/477,756, filed on Apr. 21, 2011.

(51) Int. Cl.

| | |
|---|---|
| ***E02D 5/02*** | (2006.01) |
| ***E02D 5/06*** | (2006.01) |
| ***E02D 5/08*** | (2006.01) |

(52) U.S. Cl.
CPC .. *E02D 5/06* (2013.01); *E02D 5/08* (2013.01)

(58) Field of Classification Search
USPC ..... 405/277–279, 281, 285
See application file for complete search history.

(56) References Cited

U.S. PATENT DOCUMENTS

| | | | |
|---|---|---|---|
| 968,450 | A | 8/1910 | Conkling et al. |
| 4,808,039 | A | 2/1989 | Fischer |
| 6,282,762 | B1 | 9/2001 | Wall |
| 6,428,244 | B1 | 8/2002 | Wall |
| 7,390,415 | B2 | 6/2008 | Spitzer et al. |
| 7,753,623 | B2 | 7/2010 | Heindl et al. |
| 7,857,550 | B2 | 12/2010 | Heindl et al. |
| 7,935,406 | B2 | 5/2011 | Heindl |
| 7,946,791 | B2 | 5/2011 | Heindl et al. |

(Continued)

FOREIGN PATENT DOCUMENTS

| | | |
|---|---|---|
| DE | 2 018 119 | 11/1970 |
| DE | 39 07 348 | 9/1990 |

(Continued)

OTHER PUBLICATIONS

International Search Report and Written Opinion for International Application No. PCT/IB2012/000786 mailed Jul. 30, 2012 (14 pages).

(Continued)

*Primary Examiner* — Sean Andrish
(74) *Attorney, Agent, or Firm* — Conley Rose, P.C.

(57) ABSTRACT

A universal connecting element which is capable of connecting sheet pile wall components, such as sheet piles, beam piles and other sheet pile connectors, that have various types of interlocks such as Larssen locks, cold formed hooks and knob and claw locks. The connecting element includes a reverse "S" shaped profile to which has been added either a neck and head strip, for connection with a claw strip, or a claw strip, for connection with a head strip, or both.

12 Claims, 15 Drawing Sheets

(56) References Cited

U.S. PATENT DOCUMENTS

| | | | | |
|---|---|---|---|---|
| 7,955,029 | B2 | 6/2011 | Heindl | |
| 7,980,789 | B2 | 7/2011 | Heindl | |
| 8,047,754 | B2 | 11/2011 | Heinicke | |
| 2008/0152435 | A1 | 6/2008 | Heindl | |
| 2008/0310924 | A1* | 12/2008 | Heindl | 405/279 |
| 2009/0226664 | A1* | 9/2009 | Heindl | 428/100 |

FOREIGN PATENT DOCUMENTS

| | | |
|---|---|---|
| DE | 298 21 624 | 8/1999 |
| DE | 198 51 877 | 5/2000 |
| EP | 0 348 012 | 12/1989 |
| EP | 1 688 544 | 8/2006 |
| GB | 1 295 359 | 11/1972 |
| GB | 2 131 856 | 6/1984 |
| GB | 2 228 760 | 9/1990 |
| JP | 7 178410 | 7/1995 |
| WO | WO 2009/126016 | 10/2009 |

OTHER PUBLICATIONS

OHIM Trademark Registration No. 000617592-0001 registered Nov. 7, 2006.

OHIM Trademark Registration No. 000764444-0002 registered Jul. 26, 2007.

* cited by examiner

UNIVERSAL CONNECTING ELEMENT FOR SHEET PILE WALL COMPONENTS

CROSS REFERENCE TO RELATED APPLICATION

This application a National Stage Application of PCT/IB2012/000786, filed 20 Apr. 2012, which claims benefit of U.S. Provisional Application No. 61/477,756, filed 21 Apr. 2011 and which applications are incorporated herein by reference. To the extent appropriate, a claim of priority is made to each of the above disclosed applications.

BACKGROUND OF THE INVENTION

The present invention relates to a connecting element for sheet pile wall components, such as sheet piles, beam piles, pipe piles and other sheet pile components. Such sheet pile wall components are designed to be connected together to form a wall and, for this purpose, some of these components have a hooked strip profile, a neck and head strip profile and/or a claw strip profile that extends longitudinally along a lateral edge to enable their interconnection. Pipe piles and some beam piles have no such connecting elements so that separate connecting elements must be welded thereto.

Sheet pile connecting elements are known in a plurality of shapes and designs. They are used for interconnecting such sheet pile wall components and, in particular, for interconnecting two adjacent sheet piles, beam piles or pipe piles of a sheet pile wall that are arranged in a line or at a given angle with respect to each other, or for interconnecting three or more sheet pile wall components.

A connecting element for connecting sheet pile wall components that extend with respect to each other at a prescribed angle "x" is known from the Patent Publication DE OS 2,018,119, where "x" is in the range between 90° and 135°. This connecting element is formed, in profile, in the shape of the letter "S" with two oppositely directed hook strips at opposite ends. One of the hook strips is formed smaller than the other, and both engage corresponding hook strips, or so-called "Larssen" locks, of the sheet pile components to be connected.

This connecting element has the advantage that one can interconnect sheet pile wall components extending at an angle, either as a corner section with 90° or with a wider angle of between 90° and 180°.

Improved connecting elements of this type are disclosed in DE 198 51 877; DE 298 21 624; U.S. Pat. No. 6,282,762 and US 2008/0152435. In these references, the connecting elements, viewed in profile, have the shape of a backward letter "S" which allows the sheet piles considerable freedom of angular movement at their points of connection while nevertheless serving to securely connect the respective components.

Common to all these known sheet pile connecting elements is that they are only used in conjunction with sheet pile components having Larssen locks; that is, locks that are formed, in profile, with a hook having a wedge-shaped end portion.

The dimensions of these Larssen locks vary from manufacturer to manufacturer so that one must normally use sheet piles for each wall from the same manufacturer.

DE 39 07 348 discloses a number of extruded connecting elements which are designed for sheet piles with interlocks of the above-mentioned Larssen type, and also sheet pile components having "thumb and finger" type locks. The connecting elements have, for the Larssen locks, variously shaped hook strips which always require shape mating with the locks of the sheet piles. However, the continuous casting production method used to produce these connecting elements permits more diverse shapes of the connecting strips and allows smaller dimensional tolerances to be achieved than with rolled sections.

Thumb and finger type locks are also the subject of U.S. Pat. Nos. 7,753,623 and 7,946,791 which disclose numerous connecting elements designed to interconnect three sheet pile wall components.

The European OHIM Design No. 000617592 and U.S. Pat. Nos. 7,390,415; 7,935,406; 7,955,029 and 7,980,789 disclose various embodiments of connecting elements with so-called "knob and claw" type locks for sheet piles.

There is one further type of lock which is essentially a simple hook, as in the letter "J", that is normally produced by cold forming metal (steel) plates or sheets. Such hook-type locks are disclosed, for example, in U.S. Pat. No. 8,047,745; EP 1 688 544 A1; OHIM 00764444; GB 2,131,856 and GB 2,228,760.

Because of the many types of sheet pile locks, civil engineers designing sheet pile walls are somewhat limited in their choice of sheet pile wall components since all of the locks must be compatible for interconnection. For any given project, one type of lock is normally selected and utilized throughout.

SUMMARY OF THE INVENTION

A principal objective of the present invention is to provide a connecting element for sheet pile components of the type described above which can be used in conjunction with a wide variety of known sheet pile locks, including variously shaped Larssen Locks, thumb and finger locks, knob and claw type locks, as well as cold formed hook locks.

It is a further object of the present invention to provide a connecting element for sheet pile components which establishes and retains the connection during installation over a wide range of angles.

These objects, as well as further objects which will become apparent from the discussion as follows, are achieved, in accordance with the present invention, by providing a connecting element for sheet pile wall components having a reverse "S" profile formed with the following sections:

(a) a substantially linear central strip having first and second ends and first and second lateral sides;

(b) a first hook strip extending from the first end of the central strip, commencing in the same longitudinal direction as the central strip, curving around in an arc of between 180° and 270°, and terminating in a free end pointing substantially toward, and spaced from, the first side of the central strip to form a first hook for engaging a hook strip profile of a sheet pile component; and (c) a second hook strip extending from the second end of the central strip, commencing from the first side of the central strip in a direction substantially perpendicular thereto, curving around in an arc of between 180° and 270°, and terminating in a free end pointing substantially toward, and spaced from, the second end of the central strip to form a second hook for engaging a hook strip profile of a sheet pile component.

This connecting element also includes one or more profile attachments to this basic structure, permitting its interconnection to sheet pile wall components having a knob and claw (ball and socket) type interlocks as well as thumb and finger type interlocks. These profile attachments may exhibit one or more of the following configurations:

(d) a first claw strip formed by two opposing partial hooks, each extending in an arc of between 90° and 180° from the second side of the central strip and terminating in a free end pointing substantially toward, and spaced from, the free end of the other, opposing partial hook, for engaging a neck and head strip of a sheet pile component or a thumb and finger interlock of a sheet pile component;

(e) a second claw strip formed by two opposing partial hooks, each extending in an arc of between 90° and 180° from an outer side of the first hook strip and terminating in a free end pointing substantially toward, and spaced from, the free end of the other, opposing partial hook, for engaging a neck and head strip of a sheet pile component or a thumb and finger interlock of a sheet pile component;

(f) a head strip formed at a free end of one of the opposing partial hooks of one or both of the above-described claw strips for engaging a claw strip or a thumb and finger of a sheet pile wall component; and (g) an attachment profile formed by a neck strip, attached at an outer side of the first and hook strip, and a head strip, formed at an opposite end of the neck strip, that has a larger cross-section than the neck strip, for engaging a claw strip or a thumb and finger of a sheet pile wall component.

For a full understanding of the present invention, reference should now be made to the following detailed description of the preferred embodiments of the invention as illustrated in the accompanying drawings.

DESCRIPTION OF THE PREFERRED EMBODIMENT

The preferred embodiment of the universal sheet pile connecting element according to the present invention will now be described with reference to FIGS. 1 and 6.

Figure 1:
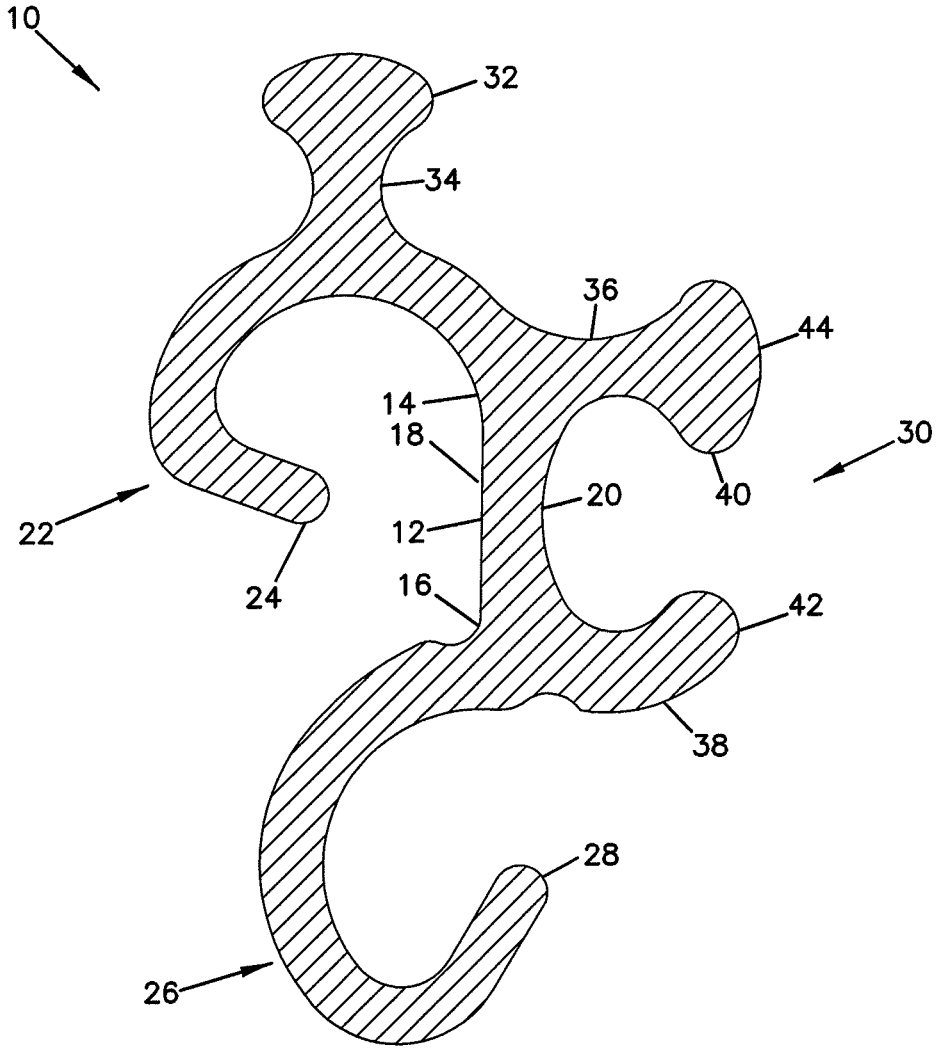
FIG. 1 is a cross-sectional (profile) view of a first embodiment of the universal sheet pile connecting element according to the present invention for interconnecting various types of sheet pile wall components.

FIG. 1 is a profile view showing the universal sheet pile connecting element 10 according to the present invention. This connecting element may be used to connect various types of Z-shaped or U-shaped sheet piles, or other sheet pile components, at various angles with respect to each other, no matter whether the sheet pile components have Larssen locks, ball and socket interlocks, thumb and finger locks or cold formed hooks.

It will be understood that the sheet pile connecting element 10 of FIG. 1 is elongate (in fact, usually many feet in length) and has a substantially constant cross-section along its length. This cross-section is shown as the profile in FIG. 1. The connecting element may be used to interconnect all types of sheet pile wall components, such as sheet piles, and other sheet pile connectors.

In profile, the connecting element includes a substantially linear central strip 12 having first and second ends 14 and 16, respectively, and first and second lateral sides 18 and 20. A first hook strip 22 extends from the first end 14 of the central strip 12, commencing in the same longitudinal direction as the central strip (that is, vertically upward as viewed in FIG. 1) and curving around in an arc of between 180° and 270°, preferably in an arc of approximately 225° as shown in FIG. 1. The arcuate hook strip terminates in a free end 24 pointing substantially toward, and spaced from, the first side 18 of the central strip, thus forming a first hook for engaging a Larssen type or cold formed hook strip of a sheet pile wall component.

A second hook strip 26 extends from the second end 16 of the central strip 12, commencing perpendicularly from the first side 18 of the central strip and curving around in an arc of between 180° and 270°. As in the case if the first hook strip, the arc of the second hook strip is preferably about 225°.

The second hook strip 26 terminates in a free end 28 pointing substantially toward, and spaced from, the second end 16 of the central strip 12 to form a second hook for engaging a Larssen type or cold formed hook strip of a sheet pile wall component.

Figure 4:
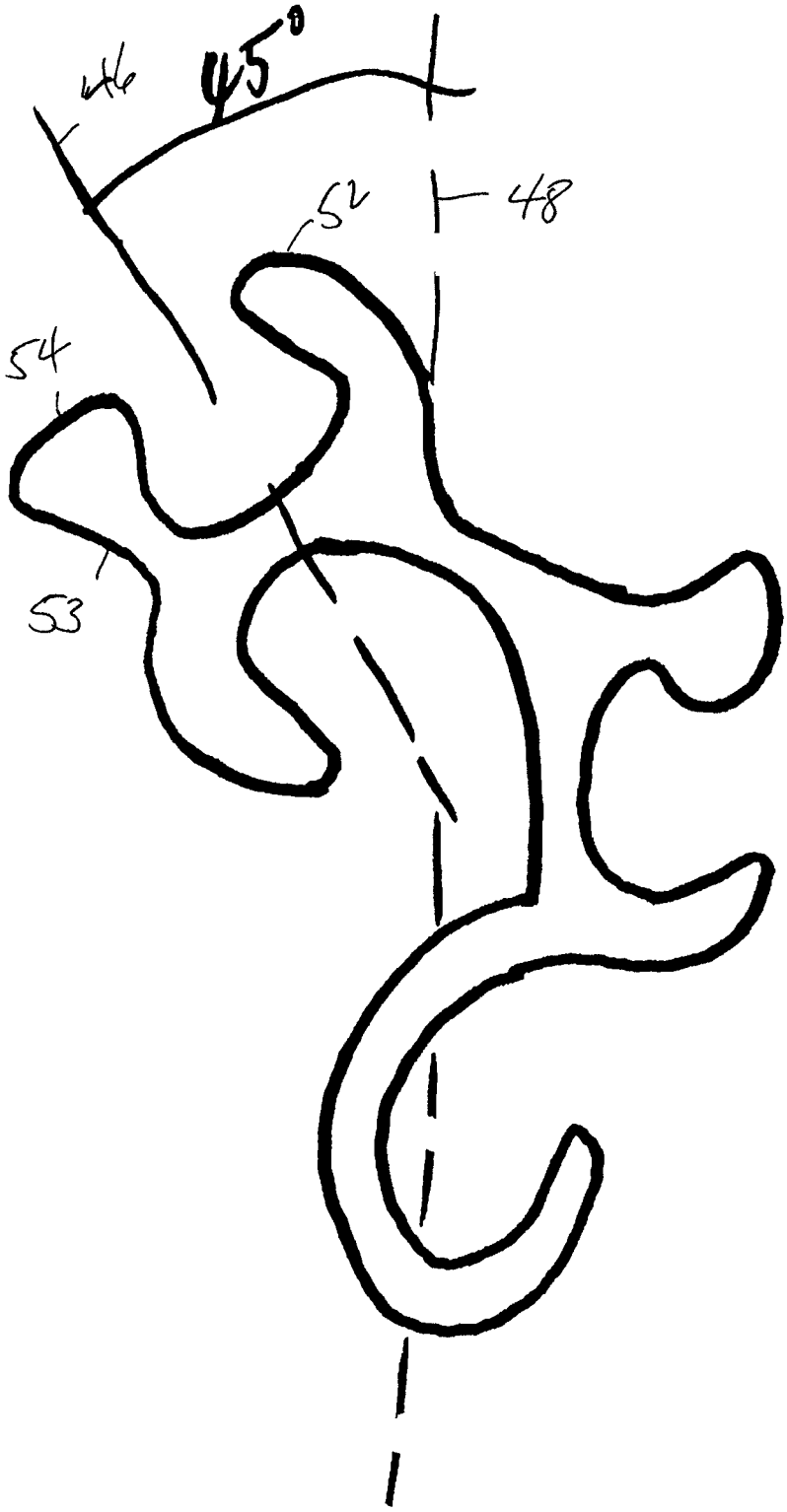
FIG. 4 is a profile view of a fourth embodiment of the universal sheet pile connecting element, similar to that of FIG. 3, in which the second claw strip has been angled by 45°.

The connecting element of FIG. 1, as thus far described, is somewhat similar to the connecting element shown in FIG. 4 of DE 198 51 877 and DE 278 21 624.

To facilitate connection to knob and claw (ball and socket) type interlocks and thumb and finger type interlocks, a claw strip 30 is formed on the second lateral side 20 of the central strip 12 and a head strip 32 is attached, via a neck strip 34, to the outside surface of one of the hook strips. In particular, the neck strip 34, and with it the head strip 32, are attached to the first hook strip 22.

The claw strip 30 is formed by two opposing partial hooks 36 and 38, each extending in an arc of between 90° and 180° from the second side 20 of the central strip 12. In the embodiment shown, the partial hooks 36 and 38 extend in an arc of about 135°. Each partial hook terminates in a free end 40 and 42, respectively, pointing substantially toward, and spaced from, the free end of the other, opposing partial hook, thus forming a claw strip for engaging a neck and head strip or a thumb and finger interlock of a sheet pile wall component or another connecting element.

The other attachment profile, comprising the head strip 32 and neck strip 34, is also preferably attached to the sheet pile connecting element for engaging a claw strip or a thumb and finger interlock of a sheet pile wall component or another connecting element. The neck strip 34 is attached to, and preferably extends outward from, the first hook strip in a direction substantially parallel to that of the central strip and terminates in the head strip 32 which is of larger cross-section than the neck strip 34.

Finally, to provide even greater usefulness and flexibility, another head strip 44 is preferably formed at the free end of one the partial hooks 36 and 38 of the claw strip 30. This head strip serves additionally for engaging a claw strip or thumb and finger interlock of a sheet pile wall component or another connecting element.

As shown in FIG. 1, the head strip 44 is preferably formed on that partial hook 36 of the claw strip which is connected to the first end 14 of the central strip 12. Alternatively, the head strip can be formed on the opposing partial hook 38, or even on both partial hooks 36 and 38.

As may also be seen in FIG. 1, the profile widths of the central strip 12 and of the first and second hook strips 22 and 26 are substantially the same and these widths remain substantially constant along their profile lengths.

It will be understood that the connecting element 10 can be formed either with or without the claw strip 30, either with or without the head strip and neck strip 32 and 34, respectively, and either with or without the head strip 44.

The universal connecting element 10 shown in FIG. 1 is capable of connecting sheet pile wall components, such as sheet piles, beam piles and other sheet pile connectors, that have various types of interlocks, such as Larssen locks, knob and claw locks, thumb and finger locks and cold formed locks, in various configurations. FIG. 6 illustrates this capability and flexibility, by showing various connection configurations, with various sheet pile interlocks, as will be described below.

Figure 2:
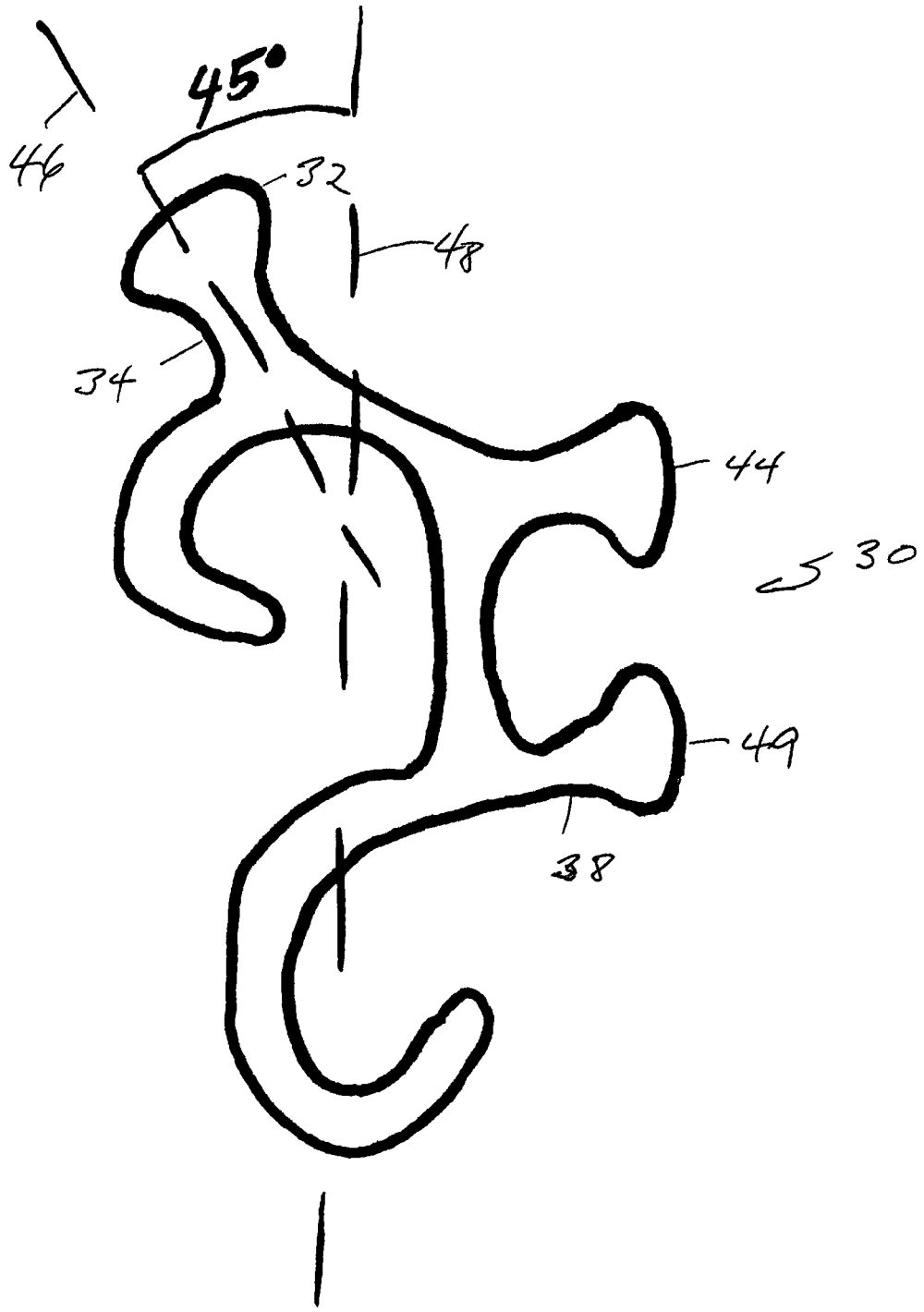
FIG. 2 is a profile view of a second embodiment of the universal sheet pile connecting element, similar to that of FIG. 1, in which the head strip has been angled by 45° and a knob has been added to one of the partial hooks of its claw.
Figure 3:
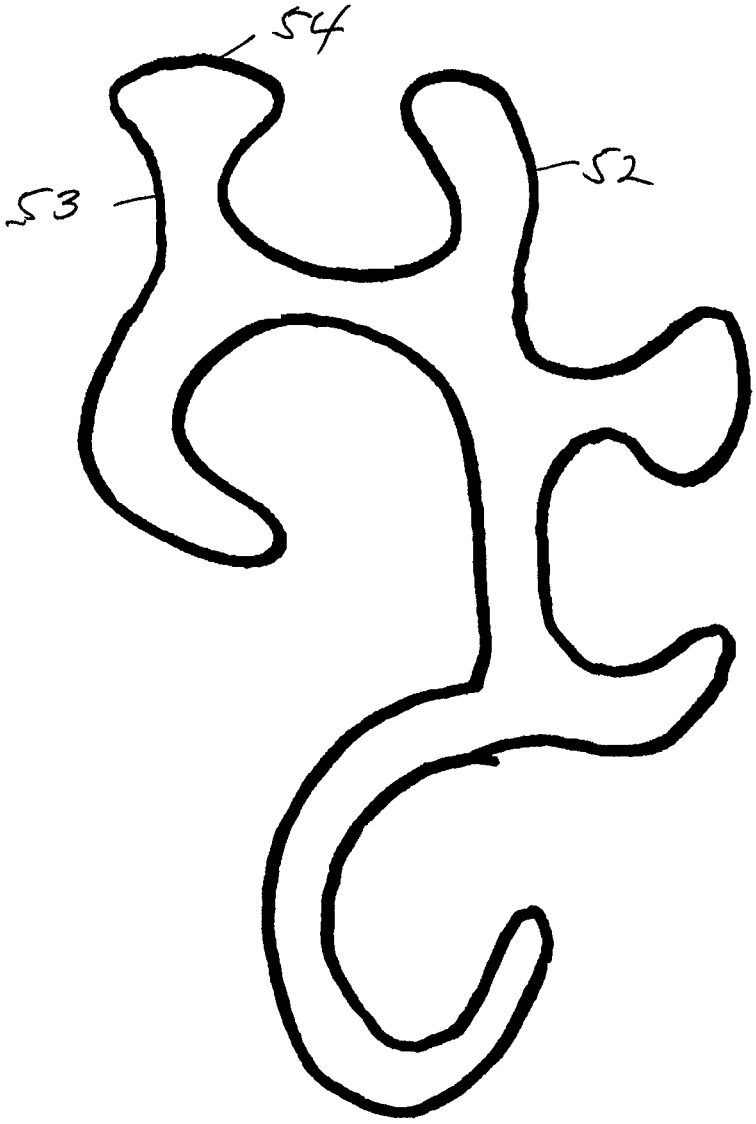
FIG. 3 is a profile view of a third embodiment of the universal sheet pile connecting element, similar to that of FIG. 1, in which the head strip connected to the first hook strip has been replaced by a second claw strip with a knob.

FIGS. 2-4 show alternative embodiments of the universal connecting element according to the present invention. The embodiment shown in FIG. 2 is substantially similar to that of FIG. 1 except that the longitudinal axis 46 of the neck strip 34 has been offset by a 45° angle from the principal axis 48 of the connecting element. Also, a head strip 49 has been added at the end of the partial hook 38 providing an essentially symmetrical claw strip 30.

In the embodiment of FIG. 3, the interlock formed by the head strip 32 and neck strip 34 has been replaced by a claw-type interlock element 50 formed by two partial claw strips 52 and 53, the latter having a head strip 54. Otherwise, this embodiment is identical to that of FIG. 1.

In the embodiment of FIG. 4, the claw strip 50 formed by the partial claw strips 52 and 53 and the head strip 54 is offset along an axis 46 which is offset by a 45° angle with respect to the main axis 48 of the connecting element.

Figure 5A:
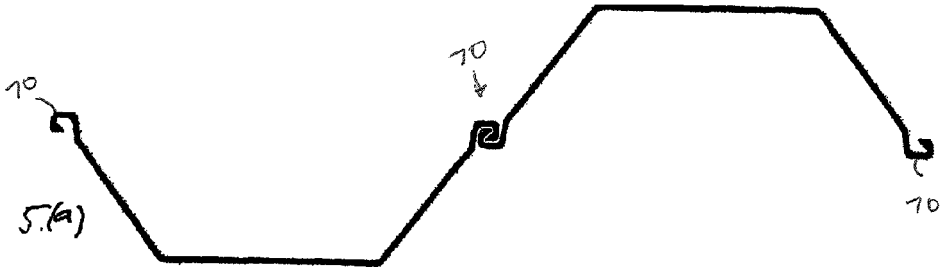
FIGS. 5(*a*)-5(*d*) are profile views of Z-shaped sheet piles of various types.
Figure 5:
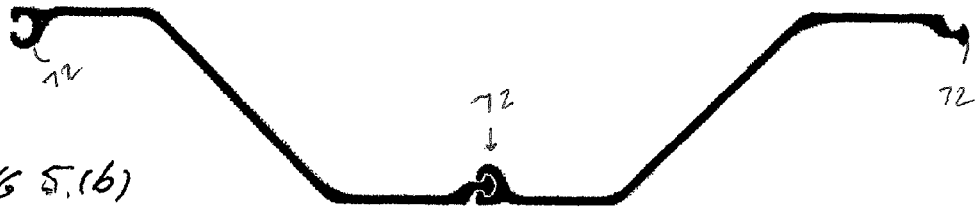
Figure 5C:
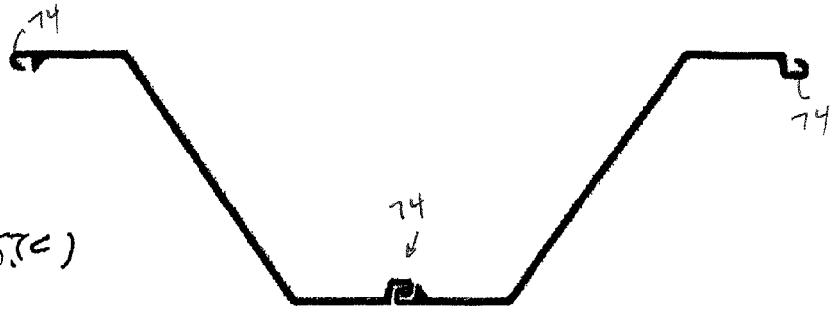
Figure 5A:
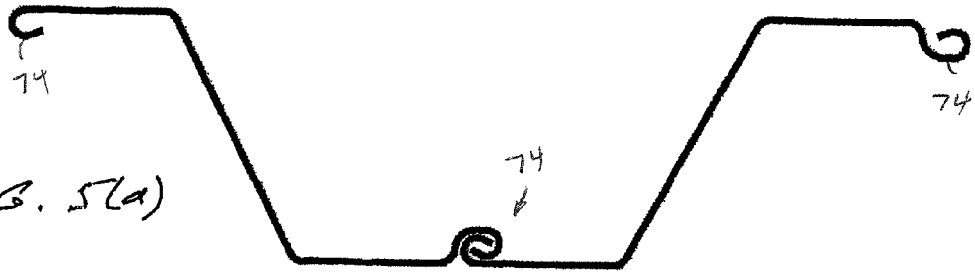
Figure 6A:
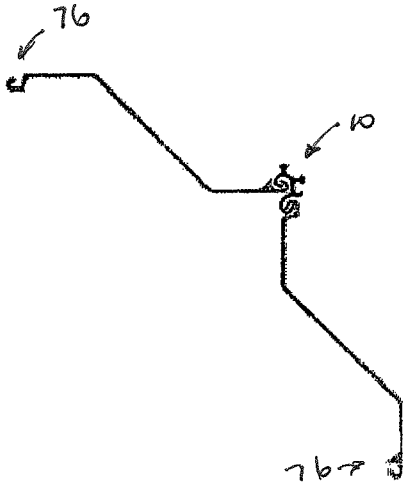
FIGS. 6(*a*)-6(*s*) profile views of the universal sheet pile connecting element of FIG. 1, employed to interconnect sheet pile components of various types in various configurations.
Figure 6B:
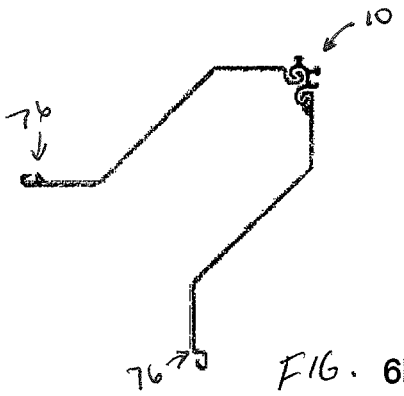
Figure 6C:
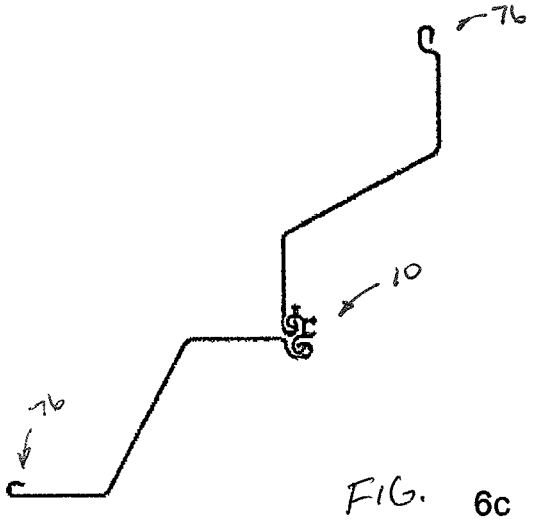
Figure 6D:
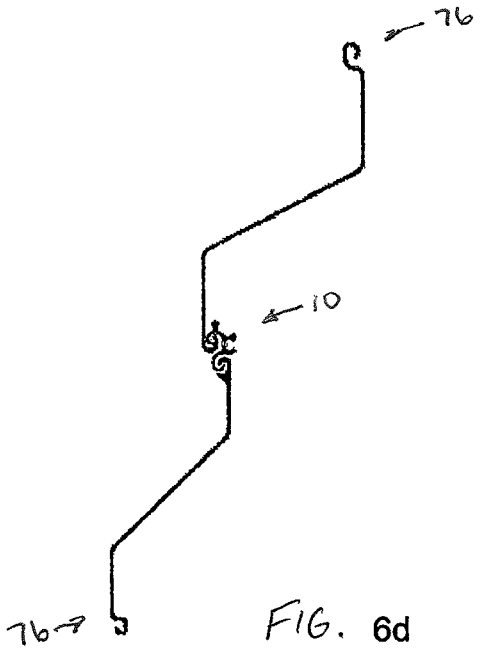
Figure 6E:
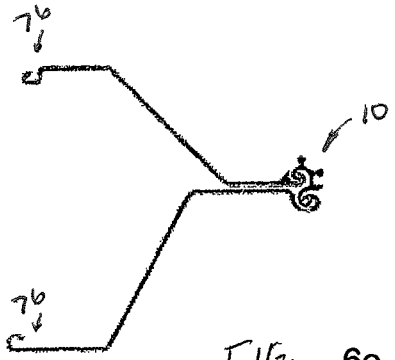
Figure 6F:
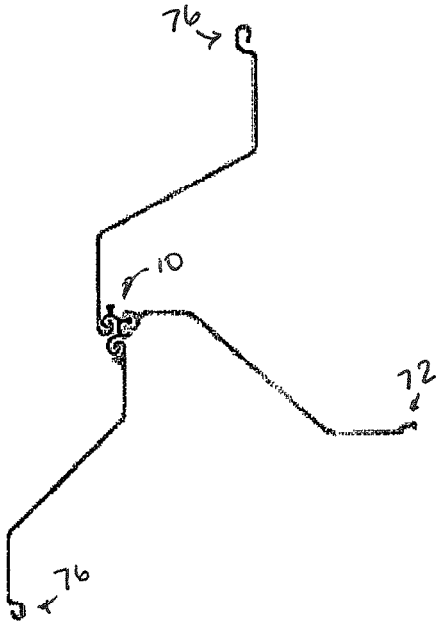
Figure 6G:
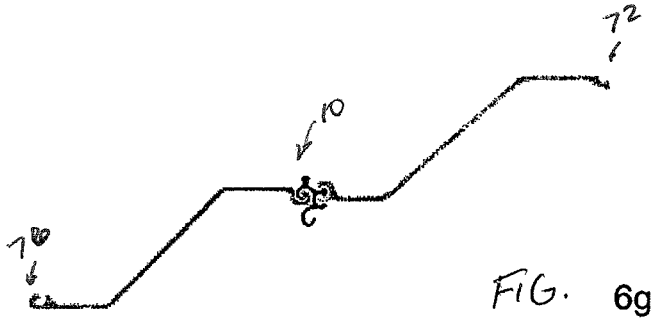
Figure 6H:
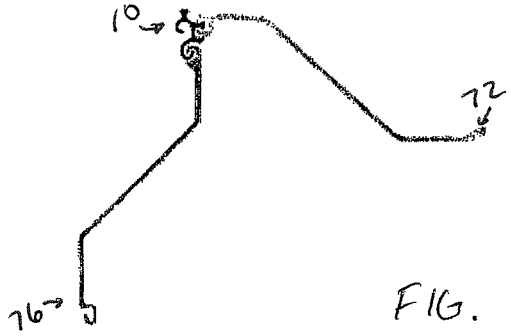
Figure 6I:
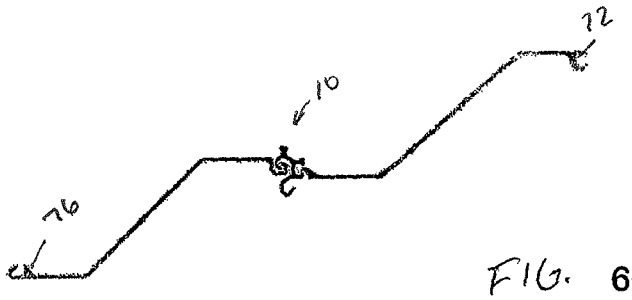
Figure 6J:
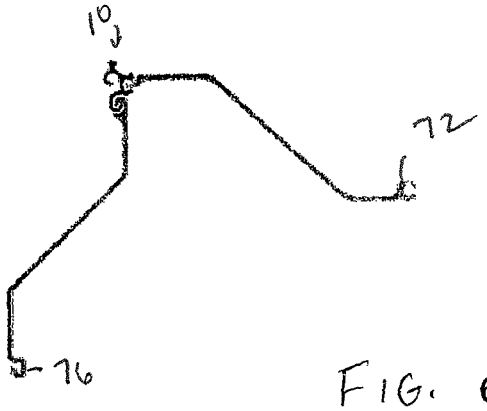
Figure 6K:
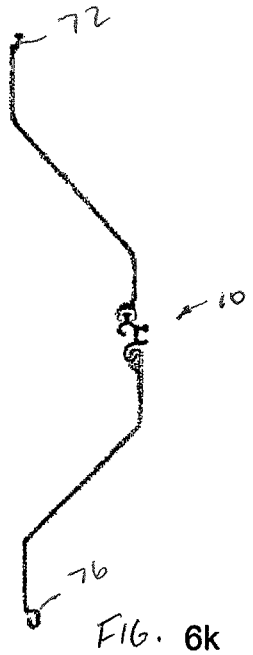
Figure 6L:
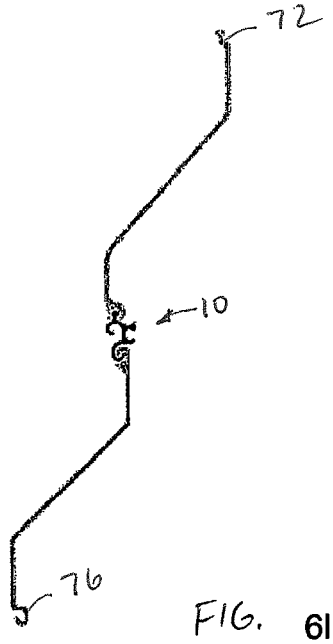
Figure 6M:
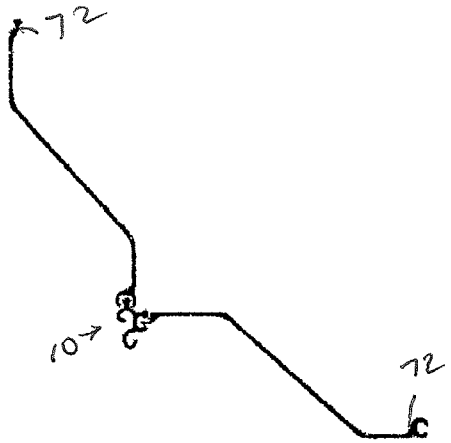
Figure 6N:
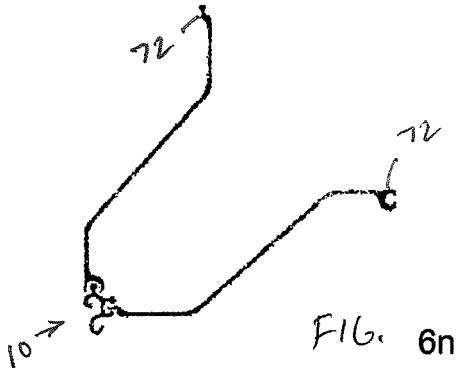
Figure 6O:
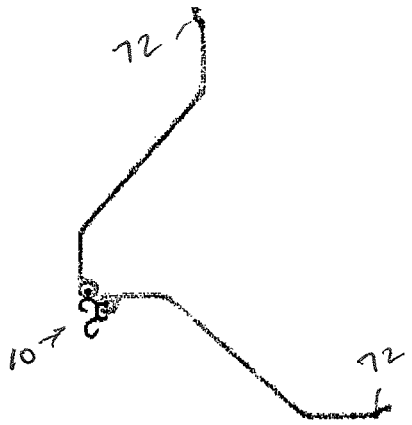
Figure 6P:
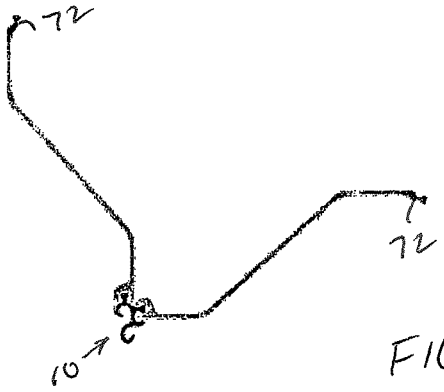
Figure 6Q:
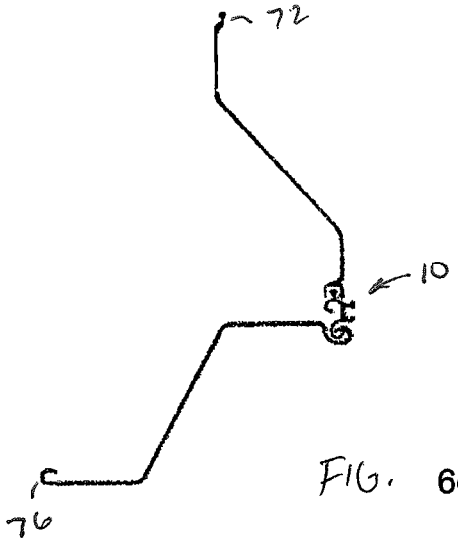
Figure 6R:
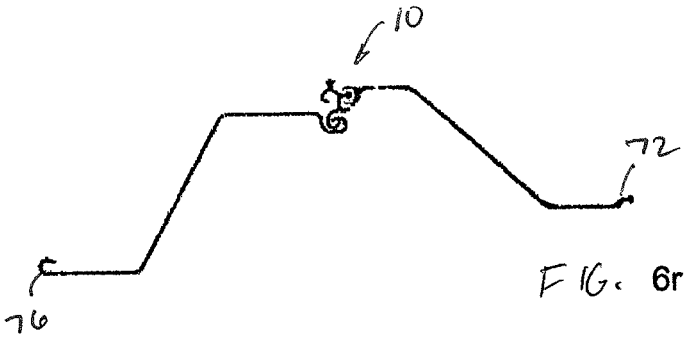
Figure 6S:
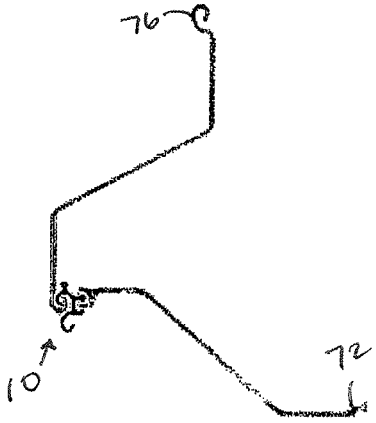

FIGS. 5(*a*)-5(*d*) illustrate standard z-shaped sheet pile components with Larssen locks 70 (FIG. 5(*a*)) knob and claw locks 72 (FIG. 5(*b*)) and cold formed locks 74 (FIGS. 5(*c*) and 5(*d*)), respectively. In all the configurations shown in FIGS. 6 (*a*) to 6(*s*) such a z-shaped sheet pile component is used for illustration; however, it will be understood that the universal connecting element 10 can connect to other types of sheet pile wall components, such as U-shaped sheet piles; beam piles of various types, such as "H" shaped piles and pipe piles; as well as other sheet pile connectors which may, for example, be welded onto the beam piles or pipe piles and which may, for example, have other types of interlocks such as thumb and finger locks.

FIGS. 6(*a*) and 6(*e*) show the connection of two z-shaped sheet piles having cold formed hooks 76 at their edges. In each of the FIGS. 6(*a*)-6(*e*), the sheet piles are connected at different angles with respect to each other.

In FIG. 6(*f*) the connection is similar to that of FIG. 6(*d*), except that an additional sheet pile with knob and claw interlocks 72 at either edge is additionally attached to the head strip 44 of the connecting element.

In FIG. 6(*g*) a sheet pile with knob and claw interlocks 72 is connected to the head strip 44 while a sheet pile with a cold form hook 76 is connected to the hook strip 22. Similarly in FIG.6(*h*) a claw interlock 72 of a sheet pile is connected to the head strip 44 whereas the cold formed hook 76 of a sheet pile is connected to the hook strip 26.

The usefulness of the universal connecting element is illustrated in FIGS. 6(*i*) and 6(*j*) wherein the head strip of a sheet pile with knob and claw connectors 72 is connected to the claw 30 of the connecting element 12 while the cold formed hook strips 76 of another sheet pile are connected to the hook strips 22 and 26, respectively.

In FIGS.6(*k*)-6(*q*) a sheet pile with knob and claw connectors 72 is connected to the head strip 32 of the universal connecting element while cold formed hook strips 76 of another sheet pile are connected to the hook strip 26 (FIGS. 6(*k*), 6(*l*) and 6(*q*)) or another sheet pile with knob and claw connectors 72 are connected to the claw 30 (FIGS. 6 (*m*) and 6(*n*)) or the head strip 44 (FIGS. 6(*o*) and 6(*p*)). Finally, as shown in FIGS. 6(*r*) and 6(*s*), a sheet pile with cold formed interlock hooks 76 is connected to the hook strips 26 and 22, respectively, and a sheet pile with knob and claw interlocks 72 is connected to the head strip 4.

The configurations shown in FIGS. 6(*a*) through 6(*s*) are merely examples of the numerous configurations which are made possible by the universal sheet pile connecting element according to the present invention. Other connection configurations will occur to those skilled in the art.

There has thus been shown and described a novel universal connecting element for sheet pile wall components which fulfills all the objects and advantages sought therefor. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

What is claimed is:

1. A universal elongate sheet pile connecting element, of substantially constant cross-section along a length of the connecting element, for interconnecting sheet pile wall components, including sheet piles, beam piles and sheet pile connectors, which have at least one of a hook strip profile, a neck and head strip profile and a claw strip profile that extends longitudinally along a lateral edge thereof, said connecting element comprising, in profile:

(a) a substantially linear central strip having first and second ends and first and second lateral sides;

(b) a first hook strip extending from the first end of the central strip, commencing in the same longitudinal direction as the central strip, curving around in an arc of between 180° and 270° and terminating in a free end pointing substantially toward, and spaced from, said first side of the central strip to form a first hook adapted to engage a hook strip profile of a sheet pile component, when the connecting element is interconnecting sheet pile components; and (c) a second hook strip extending from the second end of the central strip, commencing from the first side of the central strip in a direction substantially perpendicular thereto, curving around in an arc of between 180° and 270° and terminating in a free end pointing substantially toward and in alignment with, and spaced from, said second end of the central strip to form a second hook adapted to engage a hook strip profile of a sheet pile component, when the connecting element is interconnecting sheet pile components;

wherein (d) a claw strip formed by two opposing partial hooks, each partial hook extending in an arc of between 90° and 180° from the second side of the central strip and terminating in a free end pointing substantially toward, and spaced from, the free end of the other, opposing partial hook, for engaging a neck and head strip of a sheet pile component; and further comprising an attachment profile formed by a neck strip, attached to an outer side of the first hook strip, and a first head strip, formed at an opposite end of the neck strip, that has a symmetrical shape and has a larger cross-section than the neck strip, for engaging a claw strip of a sheet pile wall component, the neck strip extending straight outward from said first hook strip in a direction substantially parallel to said central strip.

2. The connecting element as defined in claim 1, wherein the opposing partial hooks of said claw strip are each connected to a separate one of said first and second ends of said central strip.

3. The connecting element as defined in claim 2, wherein a second head strip is formed at the free end of a first one of the opposing partial hooks of said claw strip for engaging a claw strip of a sheet pile wall component.

4. The connecting element as defined in claim 3, wherein the first one of the opposing partial hooks of the claw strip, on the free end of which is formed the second head strip, is attached to said first end of the central strip.

5. The connecting element as defined in claim 1, wherein the profile widths of the central strip and of the first and second hook strips are substantially constant throughout lengths of the central strip and first and second hook strips.

6. The connecting element as defined in claim 1, wherein the profile widths of the central strip and of the first and second hook strips are substantially the same.

7. A universal elongate sheet pile connecting element, of substantially constant cross-section along a length of the connecting element, for interconnecting sheet pile wall components, including sheet piles, beam piles, and sheet pile connectors, which have at least one of a hook strip profile, a neck and head strip profile and a claw strip profile that extends longitudinally along a lateral edge thereof to enable interconnection, said connecting element comprising, in profile:

(a) a substantially linear central strip having first and second ends and first and second lateral sides;

(b) a first hook strip extending from the first end of the central strip, commencing in the same longitudinal direction as the central strip;

(c) a second hook strip extending from the second end of the central strip, commencing from the first side of the central strip in a direction substantially perpendicular thereto, curving around in an arc of between 180° and 270° and terminating in a free end pointing substantially toward, and spaced from, said second end of the central strip to form a second hook adapted to engage a hook strip profile of a sheet pile component, when the connecting element is interconnecting sheet pile components; and (d) an attachment profile formed by a neck strip, attached to an outer side of the first hook strip, and a head strip, formed at an opposite end of the neck strip, that has a symmetrical shape and that has a larger cross-section than a horizontal cross-section of the neck strip, adapted to engage a claw strip of a sheet pile wall component, when the connecting element is interconnecting sheet pile components, the neck strip extending straight outward from said first hook strip in a direction substantially parallel to said central strip;

wherein the first hook strip is, curving around in an arc of between 180° and 270° and terminating in a free end pointing substantially toward, and spaced from, said first side of the central strip to form a first hook for engaging a hook strip profile of a sheet pile component.

8. The connecting element as defined in claim 7, wherein the profile widths of the central strip and of the first and second hook strips are substantially constant throughout a length of the central strip and first and second hook strips.

9. The connecting element as defined in claim 7, wherein the profile widths of the central strip and of the first and second hook strips are substantially the same.

10. A universal elongate sheet pile connecting element, of substantially constant cross-section along a length of the connecting element, for interconnecting sheet pile wall components, including sheet piles, beam piles, and sheet pile connectors, which have at least one of a hook strip profile, a neck and head strip profile and a claw strip profile that extends longitudinally along a lateral edge thereof to enable interconnection, said connecting element comprising, in profile:

(a) a substantially linear central strip having first and second ends and first and second lateral sides;

(b) a first hook strip extending from the first end of the central strip, commencing in the same longitudinal direction as the central strip, curving around in an arc of between 180° and 270° and terminating in a free end pointing substantially toward, and spaced from, said first side of the central strip to form a first hook adapted to engage a hook strip profile of a sheet pile component, when the connecting element is interconnecting sheet pile components; and (c) a second hook strip extending from the second end of the central strip, commencing from the first side of the central strip in a direction substantially perpendicular thereto, curving around in an arc of between 180° and 270° and terminating in a free end pointing substantially toward in alignment with, and spaced from, said second end of the central strip to form a second hook adapted to engage a hook strip profile of a sheet pile component, when the connecting element is interconnecting sheet pile components; wherein (d) a claw strip formed by two opposing partial hooks, each partial hook extending in an arc of between 90° and 180° from an outer side of the first hook strip and terminating in a free end pointing substantially toward, and spaced from, the free end of the other, opposing partial hook, for engaging a neck and head strip of a sheet pile component; and further comprising an attachment profile formed by a neck strip, attached to an outer side of the first hook strip, and a head strip, formed at an opposite end of the neck strip, that has a symmetrical shape and has a larger cross-section than the neck strip, for engaging a claw strip of a sheet pile wall component, the neck strip extending straight outward from said first hook strip in a direction substantially parallel to said central strip.

11. The connecting element as defined in claim 10, wherein the profile widths of the central strip and of the first and second hook strips are substantially constant throughout a length of the central strip and the first and second hook strips.

12. The connecting element as defined in claim 10, wherein the profile widths of the central strip and of the first and second hook strips are substantially the same.

* * * * *